United States Patent [19]

Brightman

[11] Patent Number: 4,730,559

[45] Date of Patent: Mar. 15, 1988

[54] SAFETIED DEMOLITION CHARGE FUZE

[75] Inventor: Jacob Brightman, Ramat Hasharon, Israel

[73] Assignee: The State of Israel, Ministry of Defence, Israel Military Industry, Israel

[21] Appl. No.: 59,522

[22] Filed: Jun. 8, 1987

[30] Foreign Application Priority Data

Jan. 8, 1987 [IL] Israel ..... 81198

[51] Int. Cl.[4] ..... F42C 15/02; F42C 15/34; F42C 15/00

[52] U.S. Cl. ..... 102/254; 102/487

[58] Field of Search ..... 102/204, 487, 488, 254, 102/255, 256, 275.11

[56] References Cited

U.S. PATENT DOCUMENTS

| | | | |
|---|---|---|---|
| 3,049,999 | 8/1962 | Sunden | 102/487 |
| 3,683,814 | 8/1972 | Bedall et al. | 102/487 |
| 4,493,262 | 1/1985 | Hutcheson | 102/487 |
| 4,658,725 | 4/1987 | Rudenauer et al. | 102/254 |
| 4,667,600 | 5/1987 | Jensen et al. | 102/254 |

*Primary Examiner*—Charles T. Jordan

*Attorney, Agent, or Firm*—Steinberg & Raskin

[57] ABSTRACT

A safetied demolition charge fuze of the kind that upon actuation switches from a safe to an armed state. Double safety means are provided to ensure the subsistence of a predetermined delay time. A detonator ignitable via a pyrotechnic delay charge is located within a safe-and-arm slide. In the safe state, the detonator is out of alignment with the pyrotechnic charge due to the safe position of the safe-and-arm slide. The latter is retained in the non-aligned, safe position by means of a retainer shaft which is locked in the retaining position by a heat sensitive defense mechanism. After a predetermined time delay, heat transferred from the burning pyrotechnic delay charge cause the latter to unlock and release the retainer shaft which thereupon and by yielding to its compression spring, clears the safe-and-arm slide. In consequence and by the action of springs associated with the slide the latter is urged to the armed position at which the detonator is aligned with the pyrotechnic delay charge. In consequence, when the combustion front in the pyrotechnic delay charge reaches the end close to the detonator the latter is ignited via a booster charge whereby the fuze detonates and causes the explosion of the associated demolition charge.

4 Claims, 3 Drawing Figures

Fig. 2
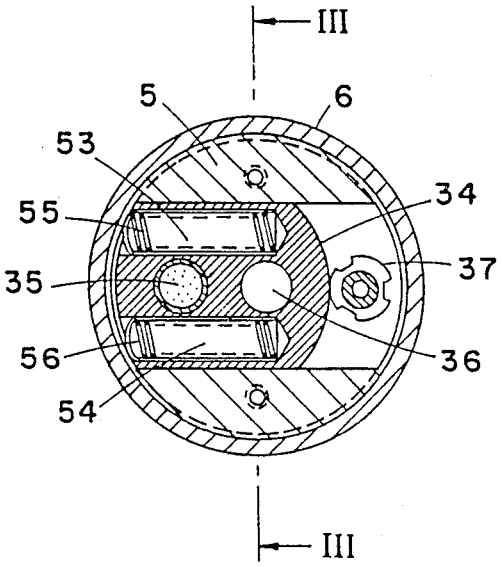
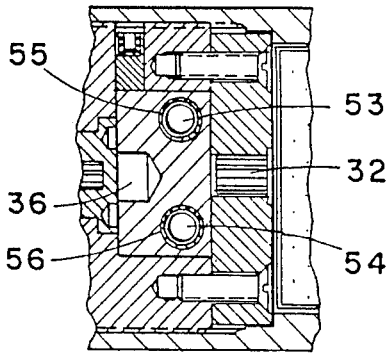
Fig. 3

SAFETIED DEMOLITION CHARGE FUZE

FIELD OF THE INVENTION

The present invention relates generally to demolition charges and concerns more particularly a safety fuze for use with such charges and designed to avoid premature detonation due to malfunctioning or to unintentional percussion.

BACKGROUND OF THE INVENTION

There are known self-contained demolition charges which comprise built-in fuzes with a primer a delay mechanism and a booster charge, so designed that upon release of an arming lever the fuze is activated and detonated after a preset delay sufficient for the operator to withdraw into safety. However, cases of premature detonation do happen with fatal consequences to the operator(s). Such premature detonation may be, for example due to malfunctioning by which the primer ignites spontaneously even though the arming lever has not been released, or alternatively may be due to direct activation of the detonator by unintentional percussions. In either case the detonator is prematurely activated whereby the booster charge is prematurely ignited which in turn causes premature explosion of the entire demolition charge with obvious fatal consequences. It is thus the object of the present invention to provide an improved fuze for demolition charges that is safe against premature activation of the detonator.

GENERAL DESCRIPTION OF THE INVENTION

With this object in view the invention provides a safetied demolition charge fuze of the type that upon actuation changes from a safe to armed state and comprises a housing with head and tail ends; an arming lever hinged to said housing and engaging an arming slider slidable by the action of activating springs from an engaging, safe position to a disengaging, armed position and retained in the safe position by said arming lever; a spring loaded firing pin; a safety lever retaining said spring loaded firing pin which safety lever is retained by said arming slider in the safe position and swings in the armed state of the fuze out of engagement with said firing pin by the action of the spring of the latter when said safety lever becomes disengaged from said arming slider; a percussion primer assembly at the head end of said housing so positioned that when said safety lever swings out of engagement with the firing pin, the latter strikes said percussion primer; a pyrotechnic delay charge having a first end close to said primer assembly and a second end turned away therefrom, which delay charge is ignitable by said primer; a detonator ignitable by said pyrotechnic delay charge; and a booster charge ignitable by said detonator; characterised in that:

(i) said detonator is borne within a safe-and-arm slide mounted inside said housing intermediary the second end of said pyrotechnic delay charge and said booster charge, which detonator is slidable between a safe position in which the detonator is out of alignment with said pyrotechnic delay and booster charges, and an armed position in which it is in alignment with both the pyrotechnic delay and booster charges, which safe-and-arm slider is biased into the armed position and retained in the safe position;

(ii) a retainer shaft is provided, associated with spring means by which it is shiftable from a safe position in which said safe-and-arm slide is retained in said safe position, and an armed position in which it clears said safe-and-arm slider whereby the latter is free to move into the armed position;

(iii) a detent mechanism is provided for locking said retainer shaft in the safe position, which detent mechanism comprises a casing, a locking member mounted within said casing and engaging a recess in said retainer shaft; means responsive to the action of said spring means of said retainer shaft for pressing said locking member so as to push it away from said retainer shaft; heat sensitive means associated with said locking member which heat sensitive means resist below a preset temperature the pressure exerted on said locking member and which soften upon raise of temperature by heat from said pyrotechnic delay charge whereby said locking member yields to the pressure exerted thereon and is pushed out of engagement with said retainer shaft whereby the latter is unlocked and moves by the action of the said associated spring means into the armed position thereby clearing said safe-and-arm slide whereby the latter is free to move into the armed position in which said pyrotechnic delay charge, detonator and booster charger are all aligned.

Thus, in the safe state of a demolition charge fuze according to the invention the detonator is out of alignment with the booster charge with the consequence that even if it is activated by a percussion or a spontaneous unintentional ignition, the demolition charge does not explode. A percussion may activate the detonator directly but due to the fact that in the safe state it is out of alignment with the booster charge the latter will not be ignited by the detonating detonator and any damage will be minimal with no fatal results. The same is also true in case of spontaneous ignition of the pyrotechnic delay charge. In this event the detonator will not be activated at all because of the non-alignment of the pyrotechnic delay charge and the detonator.

In accordance with a preferred embodiment of the invention the said retainer shaft is double locked as long as the arming lever and slider remain in the safe position. To this end the arming slider may comprise a tail portion which in the safe position of the arming slider bears on the head of the retainer shaft thereby retaining it in a depressed, safe position whereby the safe-and-arm slider that bears the detonator is retained in safe position even if said detent malfunctions in consequence of premature, spontaneous ignition of said pyrotechnic delay charge.

If desired, the fuze according to the invention may comprise a booby trap booster charge accessible from the tail end of the housing and fitted with activating means which are set into operation by predetermined remote activation or entrapment means.

DESCRIPTION OF THE DRAWINGS

For better understanding the invention will be described by way of example only, with reference to the annexed drawings in which:

FIG. 2 is a cross-section along line II—II of FIG. 1; and

FIG. 3 is a fragmentary axisl section along line III—III of FIG. 2.

DESCRIPTION OF A SPECIFIC EMBODIMENT

Figure 1:
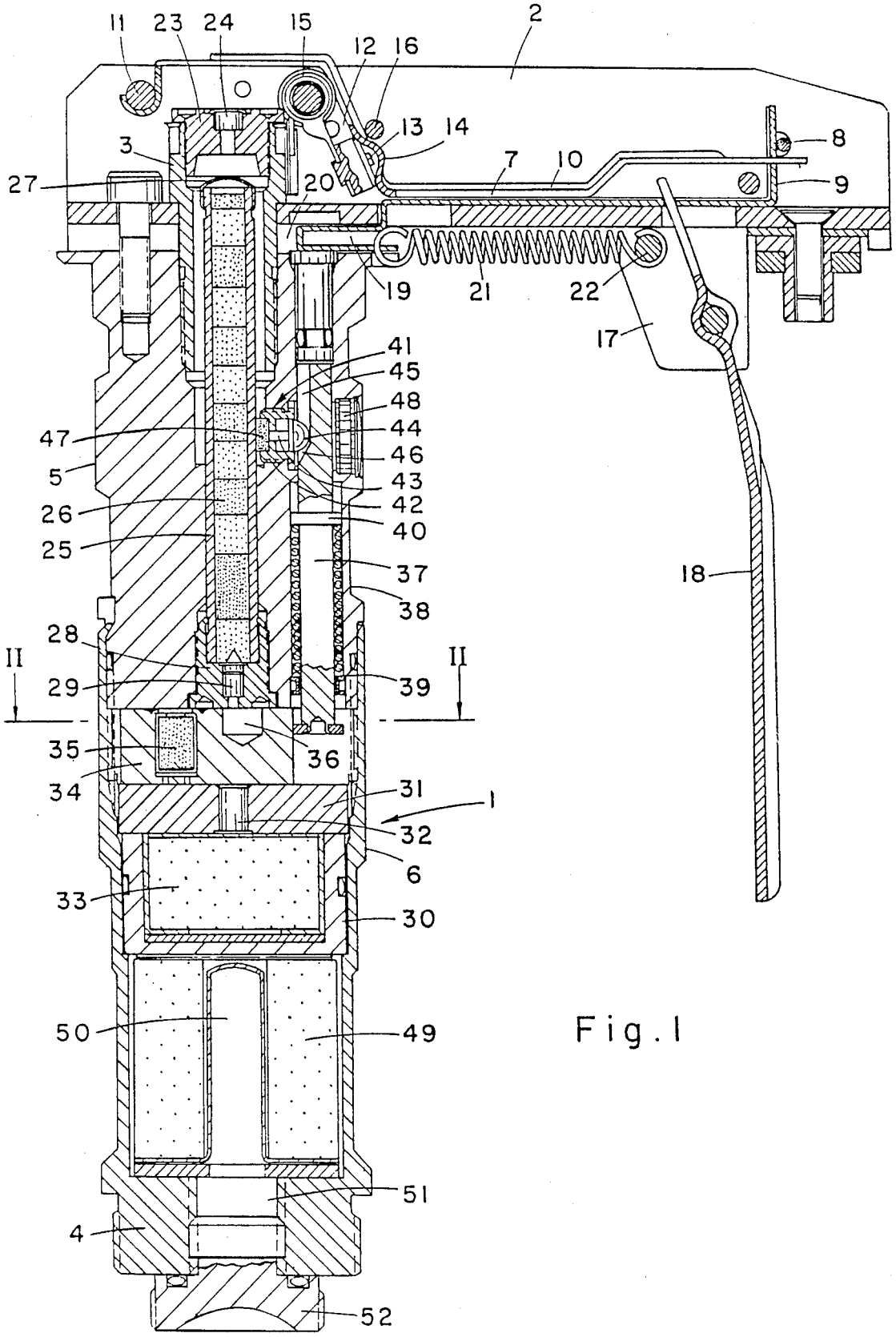
FIG. 1 is an axial section through a fuze according to the invention.

The demolition charge fuze according to the invention shown in FIGS. 1 to 3 comprises a housing having a main oblong and essentially cylindrical portion 1 and an integral, laterally extending beam 2. The main body portion 1 comprises a head end section 3, a tail end section 4, a cylindrical block section 5 and inverted cup-like body section 6 screwed onto block 5. An arming slider 7 is mounted within beam 2 and is locked in the safe position shown in FIG. 1 by means of an extractable main safety pin 8. At its right hand side end (with reference to FIG. 1) slider 7 has a vertical, bored terminal bracket 9 receiving in the safe position the end portion of a bent safety lever 10 whose other end is hinged by means of an axle 11 to the head portion 3 of the main body section 1. Safety lever 10 retains a firing pin assembly 12 comprising a firing pin 13 which in the safe position shown in FIG. 1 is shielded by a bulging guard portion 14 of lever 10. The firing pin assembly 12 is spring loaded by a spiral spring 15 which urges it to turn anti-clockwise, such movement being however prevented in the safe state of the fuze by lever 10 as long as the latter remains in the safe position by being retained by arming slider 7 in the manner shown. During transportation and storage, the safety lever 10 is additionally secured by means of a secondary extractable safety pin 16 which is, as a rule, removed when the demolition charge with the fuze in it is issued for operation.

Hinged to lugs 17 of beam 2 is an arming lever 18 whose upper end portion engages a bore of the arming slider 7 whereby lever 18 is retained in the safe position.

The arming slider comprises a double bent, U-shaped tail portion 19 slidingly received within an annular recess 20 of the main body portion 1 between head section 3 and cylindrical block section 5. Two helical tension springs 21 (activating spring, only one being seen in FIG. 1), one end of each of which is anchored in said tail portion 19 while the other end is secured at 22 to lug 17 of beam 2, pull the slider 7 from left to right thereby creating a bias by which the slider moves to the right from the safe position shown in FIG. 1 to the armed position once the safety pins 8 and 16 are extracted and the arming lever 18 is released.

Within the head portion 3 there is located a primer assembly 23 with a percussion primer 24. When in the armed state the firing pin assembly 12 is free to rotate anti-clockwise by the action of the spiral spring 15, the firing pin 13 strikes the primer 24.

Within an axial tubular bore of block section there is located a tubular member 25 holding a train of a pyrotechnic delay charge 26 and covered from above by a cap 27 with an access hole whereby when primer 24 is activated by the firing pin 13 the pyrotechnic delay charge is ignited. The second end of the pyrotechnic delay charge assembly 25,26 that is turned away from head section 3 is received by a plug 28 having an axial bore holding a booster charge 29.

On a shoulder within the cup0like body section 6 is seated a trough 30 which is covered by a partition 31 holding a lead charge 32. Trough 30 and partition 31 form together a sealed chamber holding a booster charge 33.

Within a chamber formed between the lower end of block 5 and partition 31 there is located a safe-and-arm slide 34 capable of sliding laterally within said chamber. The safe-and-arm slide 34 holds a detonator 35 which in the safe state is out of alignment with the pyrotechnic delay charge 26 and the lead charge 32. The safe-and-arm slide 34 also comprises a gas expansion retainer 36.

A retainer shaft 37 is located within an axial bore of block 5 and is capable of sliding therein in axial direction. Retainer shaft 37 is spring loaded by a helical, compressed spring 38 confined between a shoulder 39 assembled to block 5 and a collar 40 of the shaft. By the action of spring 38 retainer shaft 37 is biased upwards in the direction of beam 2 but is retained in its depressed, safe position against the action of spring 38 by tail portion 19 of the arming slider 7 and by a detent mechanism 41. In consequence of the combined action of these retaining means on shaft 37 the latter is locked in the safe position as shown in FIG. 1 in which it in turn locks the safe-and-arm slide 34 in the safe position, equally as shown in FIG. 1.

The detent mechanism 41 comprises a casing 42, a locking member 43 having a dome-shaped head portion 44 engaging a groove 45 of retainer shaft 37, which groove 45 comprises a slanting surface 46 which by the action of spring 38 is urged against head portion 44 of locking member 43, thereby exerting pressure on the locking member which tends to push it out of engagement with retainer shaft 37.

Detent mechanism 41 further comprises a thermoplastic filler 47 which normally withstands the pressure exerted on locking member 43 as specified, being, however, designed to soften at the temperature transferred via the wall of tube 25 when the combustion front of the pyrotechnic delay charge 26 passes the zone of the detent mechanism 41. Softening of filler 47 will thus occur after a preset time delay from the initiation of the combustion of the pyrotechnic delay charge 26, such delay depending on the position of the detent mechanism 41 along tube 25. The cavity which houses detent 41 is sealed at 48. The delay time is adjustable within certain limits by means of utilization of different compositions of filler 47, in any suitable manner, or by reorientation of the proximity of internal components or by adjustment of their dimensions.

Within a chamber formed by trough 30 and the tail end 4 of the main body portion 1 there is located a booby trap booster charge 49 which is activated by an initiation mechanism (not shown) located within a socket 50 accessible via a bore 51 in tail end portion 4 and sealed by means of a cap 52. The design of this mechanism is such that the booster charge 49 detonates upon predetermined remote activation of entrapment means of the demolition charge of which the fuze forms part.

The manner in which the safe-and-arm slide 34 is biased into the armed position is shown in FIGS. 2 and 3. As shown, slider 34 comprises bores 53 and 54 receiving helical springs 55 and 56 respectively, which in the safe position are compressed with their outer ends bearing on the wall of cup-like section 6 whereby slide 34 is urged to move from left to right in FIG. 2.

The functioning of the fuze described hereinbefore is as follows:

When the demolition charge is taken out of storage the secondary safety pin 16 is removed. For operation, the main safety pin 8 is withdrawn and from thereon the fuze is maintained in the safe position solely by the operator gripping arming lever 18 and pressing it against a body member of the demolition charge (not shown). Upon release of the arming lever 18 it no longer offers any resistance to the movement of the arming slider 7 which accordingly yields to the pulling action of the activating springs 21. In consequence arming slider 7 moves from left to right (with reference to FIG. 1), thereby releasing the safety lever 10. Upon this release lever 10 becomes free to rotate about axle 11 and does so in consequence of the pressure exerted upon it by the firing pin assembly 12 which in turn is urged to rotate anti-clockwise by spiral spring 15. In consequence of this the safety lever 10 is thrown out of contact with the firing pin assembly 12 and the latter rotates anti-clockwise until the firing pin 13 strikes primer 24 of percussion primer assembly 23. By this the pyrotechnic delay charge 26 is ignited and a combustion starts to progress along the charge.

In consequence of the arming slider 7 moving from left to right, the tail portion 19 thereof clears the head of retainer shaft 37 which thereby would be free to move upwards in consequence of the action of the compressed helical spring 38 but for the locking effect of detent 41. When the combustion front passes along the zone of detent 41 the combustion heat transferred across the wall of body 25 causes the cushion 47 to soften whereupon locking member 43 yields to the pressure exerted on its head 44 by the slanting surface 46 and is gradually depressed whereby retainer shaft 37 is unlocked and may now move upward by the action of spring 38. As soon as the tail portion of the upward moving retainer shaft 37 has cleared the safe-and-arm slide 34, the latter is urged into the armed position by the action of springs 55 and 56 whereby detonator 35 becomes aligned with the pyrotechnic delay charge 26 and the lead charge 32 of booster charge 33.

When the combustion front of the burning pyrotechnic delay charge reaches the second end thereof detonator 35 is ignited and detonates whereupon booster charge 33 is detonated via lead charge 32. The detonation of booster charge 33 shatters the cup-like body portion 6 and in this way the demolition charge is ignited and exploded.

What is claimed is:

1. In a safetied demolition charge fuze of the kind that upon ignition actuation switches from a safe to an armed state and comprises a housing with head and tail ends; an arming lever hinged to said housing and engaging an arming slider slidable by the action of an activating spring from an engaging, safe position to a disengaging, armed position and retained in the safe position by said arming lever; a spring loaded firing pin; a safety lever retaining said spring loaded firing pin, which safety lever is retained by said arming slider in the safe position and swings in the armed state of the fuze out of engagement with said firing pin by the action of the spring of the latter when said safety lever becomes disengaged from said arming slider; a percussion primer assembly at the head end of said housing so positioned that when said safety lever swings out of engagement with the firing pin, the latter strikes said percussion primer; a pyrotechnic delay charge having a first end close to said primer assembly and a second end turned away therefrom, which delay charge is ignitable by said primer; a detonator ignitable by said pyrotechnic delay charge; and a booster charge ignitable by said detonator; the improvement by which:

(i) said detonator is borne within a safe-and-arm slide mounted inside said housing intermediary the second end of said pyrotechnic delay charge and said booster charge, which detonator is slidable between a safe position in which the detonator is out of alignment with said pyrotechnic delay and booster charges, and an armed position in which it is in alignment with both the pyrotechnic delay and booster charges, which safe-and-arm slide is biased into the armed position and retained in the safe position;

(ii) a retainer shaft is provided, associated with spring means by which it is shiftable from a safe position in which said safe-and-arm slide is retained in said safe position, and an armed position in which it clears said safe-and-arm slide whereby the latter is free to move into the armed position;

(iii) a detent mechanism is provided for locking said retainer shaft in the safe position, which detent mechanism comprises a casing, a locking member mounted within said casing and engaging a recess in said retainer shaft; means responsive to the action of said spring means of said retainer shaft for pressing said locking member so as to push it away from said retainer shaft; heat sensitive means associated with said locking member which heat sensitive means resist below a present temperature the pressure exerted on said locking member and which soften upon raise of temperature by heat from said pyrotechnic delay charge whereby said locking member yields to the pressure exerted thereon and is pushed out of engagement with said retainer shaft whereby the latter is unlocked and moves by the action of the said associated spring means into the armed position thereby clearing said safe-and-arm slide whereby the latter is free to move into the armed position in which said pyrotechnic delay charge, detonator and booster charge are all aligned.

2. A safetied demolition charge fuze according to claim 1, wherein in the safe state a tail portion of said arming slider bears on said retainer shaft.

3. A safetied demolition charge fuze according to claim 1, wherein said heat sensitive means of said detent mechanism comprises a thermoplastic filler which softens by heat from the burning pyrotechnic delay charge.

4. A safetied demolition charge fuze according to claim 1, wherein comprising inside the housing near the tail section thereof a booby trap booster charge.

* * * * *